United States Patent [19]

Kroppenstedt

[11] 3,974,948

[45] Aug. 17, 1976

[54] WEB TENSION CONTROL DEVICE

[75] Inventor: Dietmar Kroppenstedt, Griesheim, Germany

[73] Assignee: Maschinenfabrik Goebel, GmbH, Darmstadt, Germany

[22] Filed: Mar. 5, 1975

[21] Appl. No.: 555,600

[30] Foreign Application Priority Data

Mar. 11, 1974 Germany ..... 2411482

[52] U.S. Cl. ..... 226/38; 226/44; 242/75.42; 242/75.53

[51] Int. Cl.[2] ..... B65H 25/04

[58] Field of Search ..... 226/44, 38, 39, 45; 242/75.42, 75.43, 75.53

[56] References Cited

UNITED STATES PATENTS

| | | | |
|---|---|---|---|
| 2,472,548 | 6/1949 | Schnell | 242/75.43 |
| 3,083,887 | 4/1963 | Huck | 226/41 |
| 3,701,493 | 10/1972 | Welsch | 242/75.53 |
| 3,782,653 | 1/1974 | Jones | 226/38 X |

*Primary Examiner*—Richard A. Schacher
*Attorney, Agent, or Firm*—Watson, Cole, Grindle & Watson

[57] ABSTRACT

In a web processing machine wherein a continuous web is fed over idler rollers so as to form a web loop at which the web passes over a sensing roller mounted on rod members for pivotal movement toward and away from the idler rollers, a web tension control means includes a brake device controlled by movement of the sensing roller for maintaining a predetermined tension in the web, a pair of piston and cylinder units connected between the rod members and the machine, the chambers between these units on opposite sides of the pistons thereof being so interconnected with each other and with a fluid pressure supply line as to render the dampening effect of the units dependent on a particular position of the sensing roller.

4 Claims, 3 Drawing Figures

WEB TENSION CONTROL DEVICE

BACKGROUND OF THE INVENTION

1. Field of the Invention

This invention relates generally to a device for controlling the tension in a continuous web of paper, foil, cloth or the like material fed through a web processing machine, and more particularly to such a device which makes use of a web-tension sensing roller carrying fluid pressure piston and cylinder units for dampening pivotal movement of such roller.

2. Description of the Prior Art

Web processing machines, including printing machines, cutting machines, etc., often include devices for controlling the tension of the web fed therethrough. The continuous web to be processed is led over an appropriate arrangement of guide rollers forming a web loop at which the web passes over a web-tension sensing roller rotatably mounted on rod members for pivotal movement toward and away from the idler rollers. During operation of the machine, a change of the tension or stretch of the continuous web effects a change in the size of the web loop thereby altering the position of the sensing roller. A brake device on the web feed roll is connected to such rod members so as to be controlled by the sensing roller for controlling the feed rate of the web to maintain a predetermined tension thereof.

Normally, however, the sensing roller or those rod members to which the roller is rotatably mounted within the machine are loaded by weights in such a manner that the position of the weights can be partially altered. The continuous web to be processed is accordingly tensioned to an amount depending on the weight of the sensing roller and the weights attached thereto. However, the larger the weights acting on the web, the larger are the masses which must be moved with a changing of the web loop. And, in order to render the control of the weights as sensitive as possible to the web, the masses of the weights must be maintained as low as possible without changing the force of the sensing roller resting on the continuous web.

Among prior art, U.S. Pat. No. 3,083,887 to Huck discloses a web tension control mechanism wherein force is applied to the sensing roller by means of a pressure cylinder in such a manner that the force on the sensing roller is effected by the diameter of the pressure cylinder or its piston, and from the pressure to which the cylinder and piston unit is subjected. The disadvantage of such a prior art mechanism is that the dampening effect on the sensing roller provided by such a piston and cylinder unit is principally dependent on the dimensions of such unit which, of course, remains constant during the operation of the machine. Another problem which such prior art mechanism fails to solve is with respect to the loading of the web processing machine, i.e., at the time a new continuous web is introduced into the machine and starts to stretch when the machine is started up. This involves a special problem which must be reckoned with since, when a new continuous web is introduced into the machine, it is generally not subject to any tension at that time so that the web loop in rolling contact with the sensing roller is of a maximum size. Therefore, in accordance with the standard arrangement, the brake which is associated with the web feed roller and which is controlled by the sensing roller would be applied as much as possible since the maximum size of the loop must be taken up and the tension in the continuous web must be increased by additionally braking the feed roll. Also, at the start of operation of the machine, the continuous web begins stretching and clinging to the sensing roller since, because of its mass, the sensing roller functions as though rigidly mounted and since, at the same time, the web feed roll is prevented from unwinding because of the condition of the sensing roller. And, if the machine is quickly started up, a high tension is developed almost immediately in the continuous web which can reach such a degree of tension as to cause web rupture. In order to moderate this effect, the sensing roller has been connected with a piston and cylinder unit or a shock absorber as, for example, disclosed by U.S. Pat. No. 3,083,887. However, as mentioned hereinabove, such a shock absorber has a dampening effect which is only dependent on the dimension thereof which dimension remains constant throughout the operation of the machine.

SUMMARY OF THE INVENTION

It is the principal object of the present invention to provide a device for maintaining tension in a continuous web fed through a web processing machine whereby the load for the sensing roller can be selected within certain limits, the sensing roller having a low mass and the dampening effect of the present device being dependent upon the respective position of the sensing roller.

Another object of this invention is to provide such a control device which includes a pair of cylinder and piston units connected between the web processing machine and the pivotable rod members on which the sensing roller is rotatably mounted. The volume size of the pressure chambers on opposite sides of the pistons of these units therefore varies with the pivotable movement of the rod members, and a pressure chamber of decreasing volume on one side of one of the pistons is interconnected with a pressure chamber of increasing volume on the other side of the other of the pistons, a fluid pressure supply line likewise being interconnected with these connections.

Another object is to provide such a control device wherein the connecting lines between such pressure chambers of the units are provided with throttle elements together with by-passing one-way fluid check valves allowing fluid to flow from the supply line toward both units, the throttles avoiding any abrupt deflections of the sensing roller and thereby preventing braking of the web during fast starts of the web movement.

A further object of this invention is to provide such a control device which further includes an interconnection of the other side of the piston in the first unit with one side of the piston in the other unit, a second fluid pressure supply line opening into this connection and being connected through a fluid gate valve from the pressure source so as to permit the sensing roller to be elevated so as to open the brake on the web when loading the machine with a new continuous web.

A still further object of this invention is to provide such a control device wherein throttles and one-way by-pass check valves are likewise provided in the connecting lines which permit fluid flow from the additional supply line toward the piston and cylinder units.

Other objects, advantages and novel features of the invention will become more apparent from the following detailed description of the invention when taken in conjunction with the accompanying drawings.

DESCRIPTION OF THE PREFERRED EMBODIMENT

Figure 1:
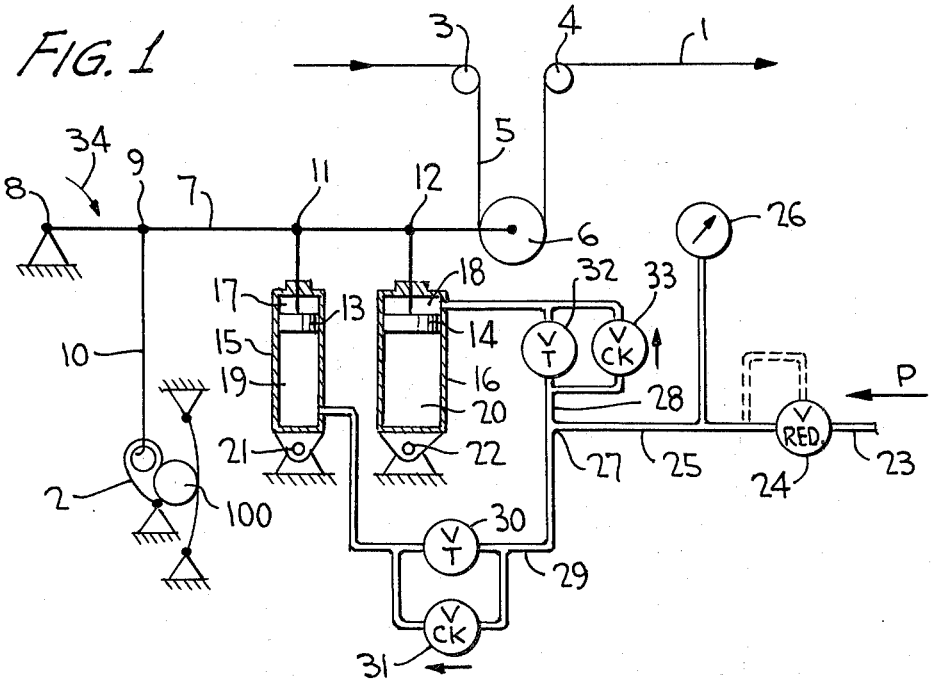
FIG. 1 is a schematic representation of the web tension control device in accordance with the present invention.
Figure 2:
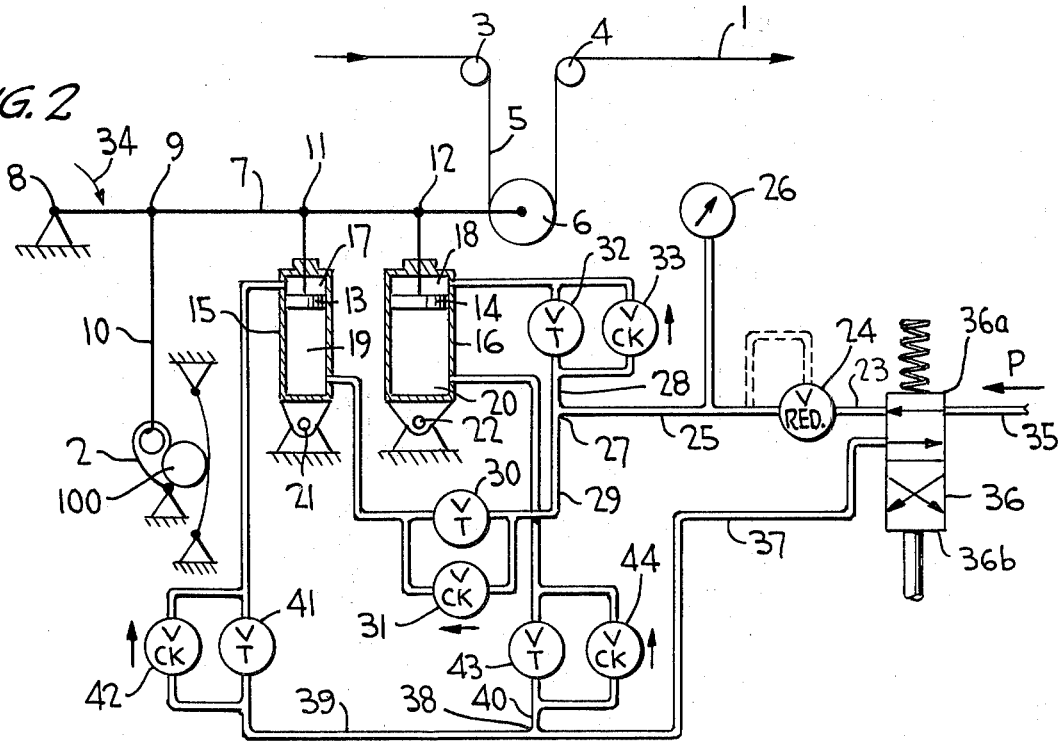
FIG. 2 is a view similar to FIG. 1 of the same control device therein plus an additional feature in accordance with the invention.

The web tension control device of the invention is shown in FIGS. 1 and 2 as a part of a web processing machine (not otherwise shown) and located at some desired position on such machine which may be a printing press, or the like.

Figure 3:
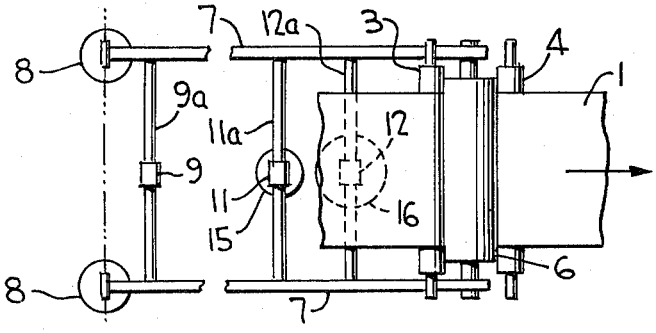
FIG. 3 is a top plan view showing a part of the control device of FIGS. 1 and 2.

Continuous web 1, shown schematically in FIGS. 1 and 2 and in plan view in FIG. 3, is reeled off a feed roll 100 in a known manner so that the details are not represented. The feed roll is associated with a brake device also in a known manner, although a brake pressure plate 2 thereof is shown schematically in FIGS. 1 and 2.

Continuous web 1 is reeled off feed roll 100 and is wound about idler guide rollers 3 and 4 disposed in such a manner as shown so as to form a web loop 5. A sensing roller 6 is disposed in this loop so that the web at the bottom of the loop passes over the sensing roller before being guided over idler roller 4 after which it continues its path through the web processing machine. As seen most clearly in FIG. 3, opposite ends of sensing roller 6 are rotatably mounted to the free ends of rod members or levers 7 which members are mounted at their opposite ends for pivotal movement at hinge joints 8. A pivot joint or sleeve 9 is provided midway between levers 7 on connecting rod 9*a*, and a brake rod linkage member 10 for the brake pressure plate is hingedly connected to the rod members at 9. Accordingly, upon a loosening of the continuous web, as its predetermined tension value decreases, sensing roller 6 will be deflected downwardly away from rollers 3 and 4 with elongation of loop 5 thereby causing downward movement of linkage 10 to apply the brake so that the web slack can be taken up by the web processing machine for restoring the necessary web tension. Conversely, upon a over-tensioning of the web, web loop 5 will be made smaller and the sensing roller will be deflected upwardly toward rollers 3 and 4 so that upward movement of linkage 10 will release the brake against the feed roll to effect an unreeling of the web so that the original value of web tension can be restored.

Rod members 7 are also provided with hinge joints or sleeves 11 and 12 provided on connecting rods 11*a* and 12*a* (FIG. 3) of the rod members. The rods of pistons 13 and 14 are respectively connected to joints 11 and 12, these pistons being respectively located for reciprocal movement within their pressure cylinders 15 and 16. Pressure chambers 17 and 18 are defined within the cylinders at one side of their respective pistons, and pressure chambers 19 and 20 are likewise defined within the cylinders at the opposite sides of their respective pistons. The cylinders are hingedly connected to a portion of the machine structure as at joints 21 and 22.

Fluid under pressure P, from a source not shown, is fed in the direction of the arrow shown in FIG. 1 through fluid pressure supply line 23 and through a pressure-reducing valve 24. The pressure prevailing in pipeline 25 downstream of the pressure-reducing valve is indicated by a pressure gauge 26. This prevailing pressure provides a measure for the force on sensing roller 6 and thus a measure for the tension of the continuous web. At junction 27, pipeline 25 branches out into two pipeline branches 28 and 29. Branch line 29 is connected to pressure chamber 19 through a fluid pressure throttle element 30 provided in this branch line which may be adjustable. A one-way fluid by-pass check valve 31 is connected in parallel over throttle element 30 so as to allow the pressure medium to freely pass in a direction toward pressure chamber 19 while preventing a return of the pressure medium therethrough. In a similar manner, branch line 28 is provided with a fluid pressure throttle element 32 therein and can be by-passed with negligible resistance in the direction flowing toward pressure chamber 18 by means of a one-way check valve 33. This check valve functions similarly as check valve 31 in that pressurized fluid cannot flow therethrough from their respective pressure chambers but must pass through the throttle elements when moving in such direction.

Thus, it can be seen that sensing roller 6 is operatively connected to pistons 13 and 14, and that the volume size of the pressure chambers 17, 18, 19 and 20 is changed when the sensing roller changes its position. Therefore, when sensing roller 6 shown in FIG. 1 is pivoted downwardly about joints 8 in the direction of arrow 34, the volume of pressure chamber 19 gets smaller by the movement of piston 13. At the same time, the volume of pressure chamber 18 gets larger during this downward movement of sensing roller 6 and rod members 7.

It can be also seen that when the deflection of sensing roller 6 and thus the movement of piston 13 and the amounts of pressurized fluid flowing out of pressure chamber 19 are low, throttle 30 provides little resistance to flow of the pressurized fluid through branch line 29 and into pressure chamber 18 through check valve 33. On the other hand, throttle 30 has an increasing effect in resisting flow of pressurized fluid therethrough during large or abrupt deflections of sensing roller 6.

Corresponding conditions develop with the deflection of sensing roller 6 in a direction opposite arrow 34 wherein pressurized fluid flows from pressure chamber 18 through throttle 32 and check valve 31 into pressure chamber 19. It can be seen that the piping system, formed by the pressure chambers and the pipelines connecting such chambers with one another is a closed one, i.e., apart from slight losses through gaskets, etc., pressurized fluid will not leak out of the system.

With reference to FIG. 2, which illustrates another aspect of the present invention together will all of the elements of FIG. 1, the pressurized fluid emanating from a fluid source (not shown) flows in the direction of the arrow shown in FIG. 2 through pipeline 35 and, instead of continuing through pipeline 23 as aforedescribed, a gate valve 36 may be provided for switching flow of the pressurized fluid into pipeline 37. Obviously, if portion 36*a* of the gate valve is aligned with pipeline 35 the pressurized fluid will proceed through pipeline 23. On the other hand, if portion 36*b* of the gate valve is aligned with pipeline 35, the pressurized fluid will be switched into pipeline 37. This line branches out into branch lines 39 and 40 at junction 38. Branch line 39 is connnected to pressure chamber 17 through throttle 41 which can be by-passed by means of check valve 42 similarly arranged as described for throttles 30 and 31 in which flow through such check valves is permitted when moving toward the respective pressurized chambers. Also, branch line 40 is connected to pressure chamber 20 through throttle 43 which may likewise be adjustable. Flow of the pressurized fluid in the direction of chamber 20 can by-pass throttle 43 with negligible resistance through check valve 44. It can be therefore seen that pressurized fluid leaving pressure chamber 17 and entering pressure chamber 20 passes through throttle 41 and check valve 44 and, in the opposite direction, passes through throttle 43 and check valve 42. Also, the volume size of pressure chamber 17 changes with the deflection of sensing roller 6, and such pressure chamber is connected with pressure chamber 20 which also changes its volume size in the opposite sense with the same deflection of the sensing roller.

In the position of the gate valve 36 shown in FIG. 2, the pressurized fluid flows through line 23 and into branches 28 and 29 toward pressure chambers 18 and 19. However, if gate valve 36 is moved into a position so that its portion **36*b* is in alignment with supply line 35, the pressurized fluid enters pipeline 37 from supply line 35 thereby blocking any flow of the pressure medium into line 23. With such a position of gate valve 36, the pressurized fluid enters chambers 17 and 20 and is therefore capable of elevating the sensing roller in a direction opposite arrow 34 for the purpose of releasing the brake so that brake pressure plate 2 is moved away from feed roll 100 thereby allowing a continuous web to be initially inserted into the machine. After the continuous web has been so inserted, gate valve 36 can be returned to its position shown in FIG. 2.**

From the foregoing, it can be seen that a simple and efficient yet highly effective and economical means has been devised for controlling the tension of a continuous web fed through a web processing machine. The pressurized fluid to be used for the present device can be any suitable gas or liquid. Because the dampening of the deflection of the sensing roller is dependent upon the deflection of the sensing roller itself, there are situations in which no dampening or only a very slight dampening thereof is required under constant operating conditions. That is, the sensing roller has a negligible effect on the brake corresponding to the respective change of the web loop of the continuous web (i.e., corresponding to each change of tension or stretch of the continuous web). However, the greater the deviation in position of the sensing roller during normal operation of the machine, the greater the need for dampening during a simultaneous change of the braking force of the feed roll. Thus, sudden increases in tension of the continuous web, particularly during the starting of the machine, are avoided. Furthermore, if pressurized fluid is applied to the pistons connected to the sensing roller through the rod members in that direction which the pressure counteracts the gravitational weight of the sensing roller, it is possible with the present invention to elevate the sensing roller for the purpose of placing a continuous web into the machine whereby the brake at the feed roll is entirely or partially released so that the feed roll can be unreeled in the same amount in which tension develops in the continuous web during a starting of the machine. The sensing roller therefore as a whole has only a small mass which avoids any sluggishness. Moreover, the components of the present device are commercially available and therefore are economical and involve minimum operating costs since the invention comprises a closed pressure medium system.

Obviously, many modifications and variations of the present invention are made possible in the light of the above teachings. For example, instead of the sensing roller being mounted in effect as a pendulum, a compensating sensing roller could likewise be used. Also, the dimensions of the pistons and of the pressure medium cylinders and the throttle passages must be coordinated and, in particular, piston 14 can be of a larger diameter than piston 13. And, for gate valve 36, a four/two path gate valve is probably the most advantageous arrangement. It is therefore to be understood that within the scope of the appended claims the invention may be practiced otherwise than as specifically described.

What is claimed is:

1. A web tension control device for a continuous web fed through a web processing machine over idler rollers arranged in such a manner as to form a web loop, the machine including a web-tension sensing roller in rolling contact with the web at the web loop, and a brake device controlled by the sensing roller for controlling the feed rate of the web to maintain a predetermined tension therein, the web tension control device including a pair of rigid rod members, opposite ends of said sensing roller being rotatably mounted to said rod members at one end thereof, and said rod members being pivotally mounted at the opposite ends thereof to the machine, said brake device being operatively connected to said rod members for control by said sensing roller and said rod members in braking the feed roll of the machine in accordance with pivotal movement of said sensing roller about said opposite ends of said rod members, first and second cylinder and piston units respectively connected between the web processing machine and said rod members, the cylinders of said units respectively having first and second pressure chambers respectively on opposite sides of the pistons thereof, the volumes of said first and second chambers of said units respectively increasing and decreasing during pivotal movement of said sensing roller about said opposite ends of said rod members, a first fluid pressure supply pipeline, first and second fluid pressure pipeline branches connected to said pipeline and respectively to said second pressure chamber of said first unit and to said first pressure chamber of said second unit, whereby a closed fluid pressure system is effected for dampening the pivotal movement of said sensing roller dependent upon the particular position of said sensing roller, and wherein fluid throttle elements together with by-passing one-way fluid check valves are provided in said pipeline branches, said valves in said branches being respectively so disposed as to permit the fluid flow from said supply pipeline toward both said units, whereby said throttle units prevent any braking action on the web during fast starts of the web movement.

2. A web tension control device for a continuous web fed through a web processing machine over idler rollers arranged in such a manner as to form a web loop, the machine including a web-tension sensing roller in rolling contact with the web at the web loop, and a brake device controlled by the sensing roller for controlling the feed rate of the web to maintain a predetermined tension therein, the web tension control device including a pair of rigid rod members, opposite ends of said sensing roller being rotatably mounted to said rod members at one end thereof, and said rod members being pivotally mounted at the opposite ends thereof to the machine, said brake device being operatively connected to said rod members for control by said sensing roller and said rod members in braking the feed roll of the machine in accordance with pivotal movement of said sensing roller about said opposite ends of said rod members, first and second cylinder and piston units respectively connected between the web processing machine and said rod members, the cylinders of said units respectively having first and second pressure chambers respectively on opposite sides of the pistons thereof, the volumes of said first and second chambers of said units respectively increasing and decreasing during pivotal movement of said sensing roller about said opposite ends of said rod members, a first fluid pressure supply pipeline, first and second fluid pressure pipeline branches connected to said pipeline and respectively to said second pressure chamber of said first unit and to said first pressure chamber of said second unit, and a second fluid pressure supply line being interconnected with said first supply line through a fluid gate valve, third and fourth fluid pressure pipeline branches connected to said second supply line and respectively to said first pressure chamber of said first unit and to said second pressure chamber of said second unit, whereby a closed fluid pressure system is effected for dampening the pivotal movement of said sensing roller dependent upon the particular position of said sensing roller.

3. The web tension control device according to claim 2, wherein fluid throttle elements together with bypassing one-way fluid check valves are provided in said third and fourth pipeline branches, said valves being respectively so disposed as to permit fluid flow from said second supply line toward both said units.

4. A web tension control device for a continuous web fed through a web processing machine over idler rollers arranged in such a manner as to form a web loop, the machine including a web-tension sensing roller in rolling contact with the web at the web loop, and a brake device controlled by the sensing roller for controlling the feed rate of the web to maintain a predetermined tension therein, the web tension control device including a pair of rigid rod members, opposite ends of said sensing roller being rotatably mounted to said rod members at one end thereof, and said rod members being pivotally mounted at the opposite ends thereof to the machine, said brake device being operatively connected to said rod members for control by said sensing roller and said rod members in braking the feed roll of the machine in accordance with pivotal movement of said sensing roller about said opposite ends of said rod members, first and second cylinder and piston units respectively connected between the web processing machine and said rod members, the cylinders of said units respectively having first and second pressure chambers respectively on opposite sides of the pistons thereof, the volumes of said first and second chambers of said units respectively increasing and decreasing during pivotal movement of said sensing roller about said opposite ends of said rod members, a first fluid pressure supply pipeline, first and second fluid pressure pipeline branches connected to said pipeline and respectively to said second pressure chamber of said first unit and to said first pressure chamber of said second unit, said first and second units being respectively spaced at first and second distances from said rod member opposite ends, said second distance being greater than said first distance, and said piston of said second unit being of a size larger than the size of said piston of said first unit, whereby a closed fluid pressure system is effected for dampening the pivotal movement of said sensing roller dependent upon the particular position of said sensing roller.

* * * * *